US007131874B2

(12) United States Patent
Kuroda et al.

(10) Patent No.: US 7,131,874 B2
(45) Date of Patent: Nov. 7, 2006

(54) ELECTRICAL CONNECTOR HAVING FIRST AND SECOND TERMINALS

(75) Inventors: Keiji Kuroda, Nishikamo-gun (JP); Ryo Moriwake, Osaka (JP); Kiyoshi Aramoto, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/199,767

(22) Filed: Aug. 9, 2005

(65) Prior Publication Data

US 2006/0035529 A1 Feb. 16, 2006

(30) Foreign Application Priority Data

Aug. 11, 2004 (JP) ..... 2004-234607

(51) Int. Cl.
*H01R 13/10* (2006.01)
*H01R 13/648* (2006.01)
*H01R 4/66* (2006.01)

(52) U.S. Cl. ..... 439/682; 439/607; 439/108

(58) Field of Classification Search ..... 439/682, 439/79, 95, 607, 609, 80, 83, 108, 188
See application file for complete search history.

(56) References Cited

U.S. PATENT DOCUMENTS 4,983,127 A * 1/1991 Kawai et al. ..... 439/79
5,288,247 A * 2/1994 Kaufman ..... 439/607
5,879,194 A * 3/1999 Thenaisie et al. ..... 439/607
6,506,074 B1 * 1/2003 Hashimoto ..... 439/541.5
6,682,368 B1 * 1/2004 Murr et al. ..... 439/607
6,755,682 B1 * 6/2004 Kunishi et al. ..... 439/495
6,966,789 B1 * 11/2005 Takaku et al. ..... 439/353
2005/0020122 A1 * 1/2005 Takaku et al. ..... 439/357

* cited by examiner

*Primary Examiner*—Chandrika Prasad
(74) *Attorney, Agent, or Firm*—Osha Liang LLP

(57) ABSTRACT

A connector comprises signal terminals that extend in one direction, a conductive tubular shell that encloses at least the ends of the signal terminals, the axis of the shell being extending in a inserting direction to the opposing connector, and a ground terminal that turns over inwardly at a rear opening edge of the shell and projects so as to extend to the portion near the front opening edge of the inserting direction. When the connector is fitted to the opposing connector, the signal terminals and the ground terminal clip a projecting part of the opposing connector, whereby the signal terminals are electrically connected to the opposing signal terminals formed on the projecting part, and the ground terminal is electrically connected to the opposing ground terminal formed on the projecting part.

4 Claims, 3 Drawing Sheets

ELECTRICAL CONNECTOR HAVING FIRST AND SECOND TERMINALS

BACKGROUND OF THE INVENTION

1. Field of the Invention

The present invention relates to a connector for electrically connecting electrical signal wires and the like.

2. Description of Related Art

As a connector for connecting electrical signal wires and the like, one including signal terminals aligned along the width direction, a ground terminal disposed so as to face the signal terminals, an insulator (housing) that retains the signal terminals and the ground terminal, and a shell covering the housing is generally known. This connector fits the opposing or mating connector by clipping a projecting part formed on the opposing connector by the signal terminals and the ground terminal. Then, when inserting the opposing connector, the signal terminals are connected to the opposing signal terminals formed on the projecting part of the opposing connector, and the ground terminal is connected to the opposing ground terminal formed on the opposing terminals. In such a connector, a technique for integral molding of the shell and the ground terminal is known (refer to Japanese Published Unexamined Patent Application No. 2003-7408). By the integral molding, the number of parts of the connector can be reduced, thereby reducing the manufacturing costs of the connector.

With the above-described technique, the signal terminals press the projecting part of the opposing connector toward the ground terminal by their elastic force. Thereby, the signal terminals and the ground terminal clip the projecting part of the opposing connector and the terminals are electrically connected. Therefore, in order to electrically connect the terminals without fail, the signal terminals must have a predetermined elastic force. However, a shape of the signal terminal is limited by a pitch of the signal terminals, and in particular, in a connector having narrow-pitch signal terminals, the widths of the signal terminals become narrow, and the elastic force of the signal terminals easily become insufficient. As a result, the terminals may become difficult to be electrically connected to the opposing terminals.

SUMMARY OF THE INVENTION

Therefore, a main object of the invention is to provide a connector which can electrically connect its terminals to the opposing terminals without fail.

The connector of the invention includes a first terminal extending in one direction, a conductive tubular shell that encloses at least the ends of the first terminal, the axis of the shell being extending in a inserting direction to the opposing connector, and a second terminal that turns over inwardly at a rear opening edge of the shell in the inserting direction and extends from the rear opening edge to a portion near a front opening edge of the shell, wherein when the connector is fitted to the opposing connector, the first and second terminal clip a projecting part of the opposing connector, whereby the first terminal is electrically connected to a signal terminal formed on the projecting part, and the second terminal is electrically connected to a ground terminal formed on the projecting part.

According to the invention, the second terminal is extended from the rear opening edge to a portion near the front opening edge of the shell, so that the spring length of the second terminal can easily be secured. Thereby, the second terminal with a proper elastic force can easily be formed. Therefore, even when the opposing connector is repeatedly inserted and extracted, the second terminal and the ground terminal of the opposing connector can be electrically connected without fail. In addition, since the second terminal is formed by being turns over inwardly at the rear opening edge of the shell in the inserting direction, when the shell and the second terminal are integrally molded, the second terminal can be formed without notching the side wall of the shell. Therefore, the strength of the shell is not lowered. Furthermore, since the shell and the second terminal are integrated together, the number of parts is reduced and the manufacturing costs of the connector are reduced.

In the invention, it is preferable that the second terminal has a plurality of projecting pieces extending from the rear opening edge to the portion near the front opening edge. According to this, by arbitrarily setting the number of projecting pieces and the width and pitch thereof, a second terminal with a more proper elastic force can be formed.

In addition, in the invention, it is preferable that the second terminal has a plurality of thin plate springs turns over inwardly at the rear opening edge of the shell in the inserting direction. Thereby, the number of thin plate springs and the width and pitch thereof can be arbitrarily set, so that the second terminal with a still more proper elastic force can be formed.

Furthermore, in the invention, it is more preferable that a housing enclosing the first terminal is further provided, and the shell encloses the housing, the projecting pieces and the thin plate springs are alternately disposed along the direction orthogonal to the inserting direction, and on the rear ends of the projecting pieces on the opposite side of the inserting direction, flat surfaces orthogonal to the inserting direction are formed. Thereby, a pressure can be applied to the flat surfaces formed on the projecting pieces, so that the housing can be efficiently press-fitted to the shell.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, a connector of an embodiment of the invention is described with reference to the drawings.

Figure 1:
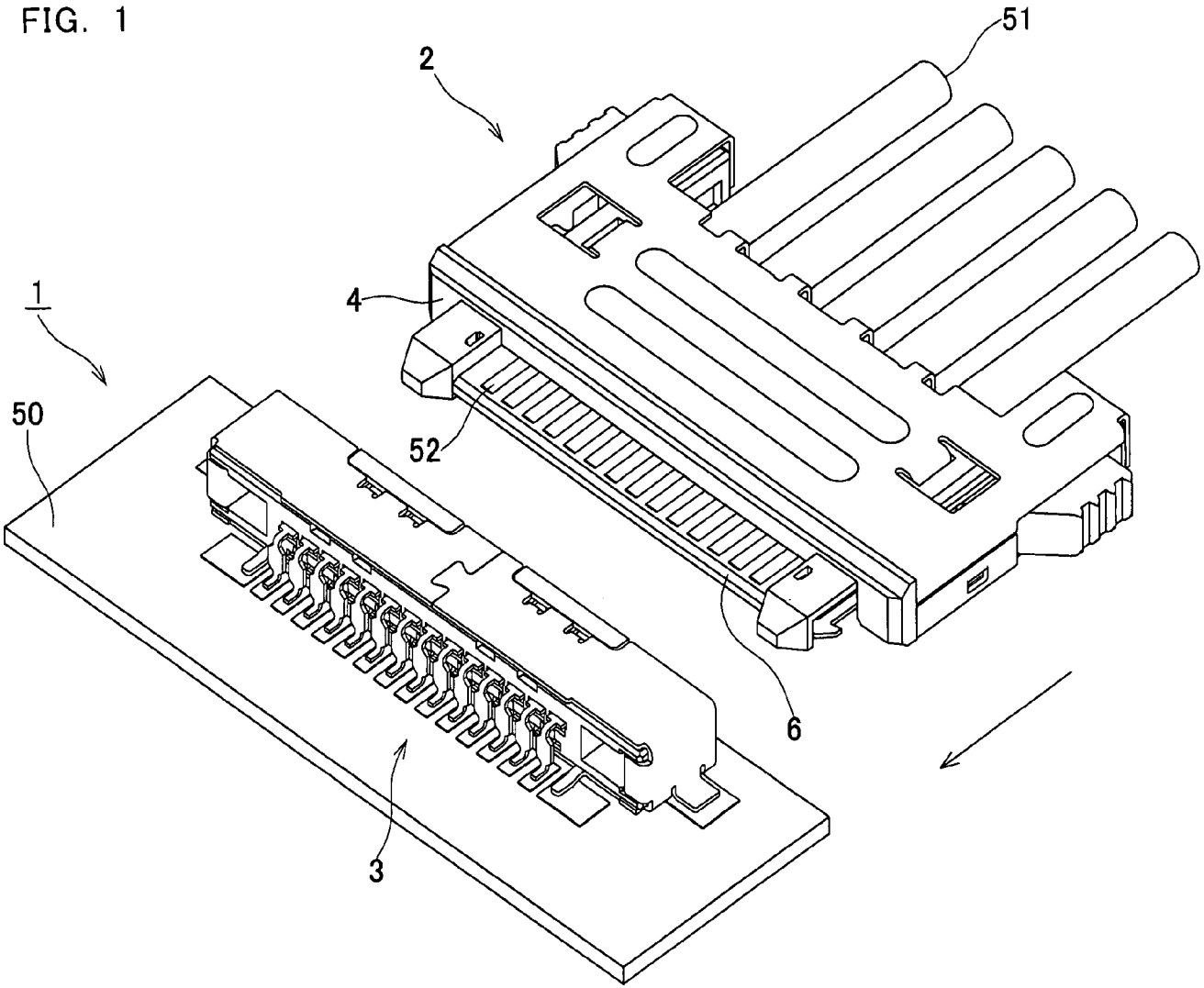
FIG. 1 is an external perspective view of a connector and the opposing connector according to an embodiment of the invention.
Figure 2A:
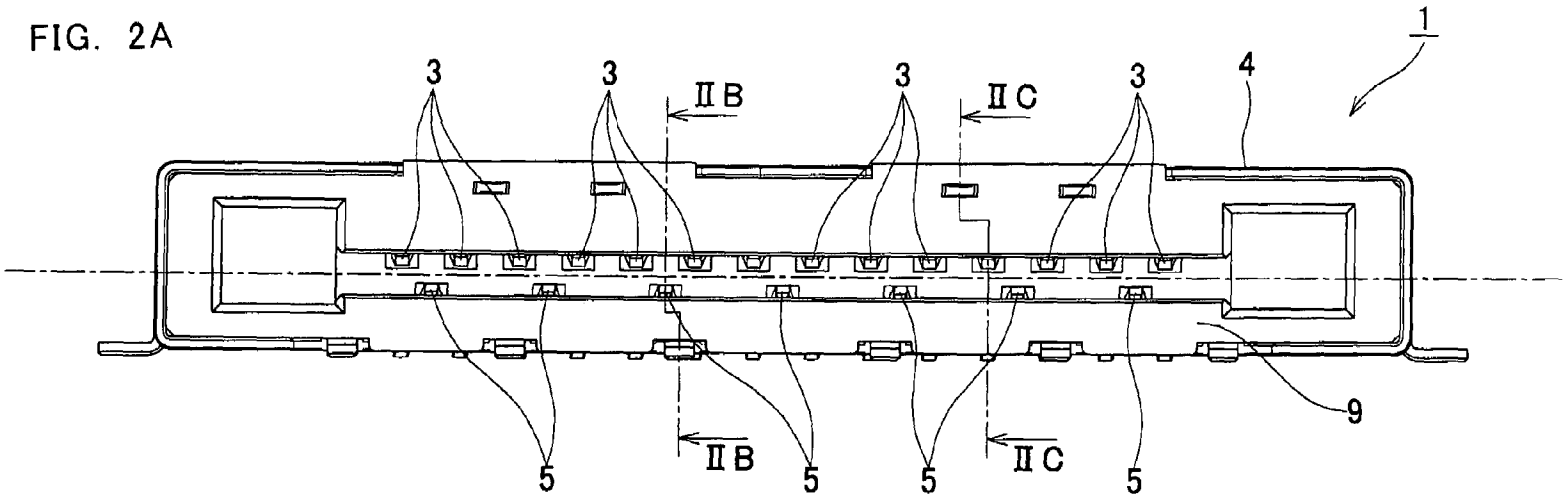
FIG. 2A is a front view of the connector 1 shown in FIG. 1 from the opposing connector inserting direction.
Figure 2B:
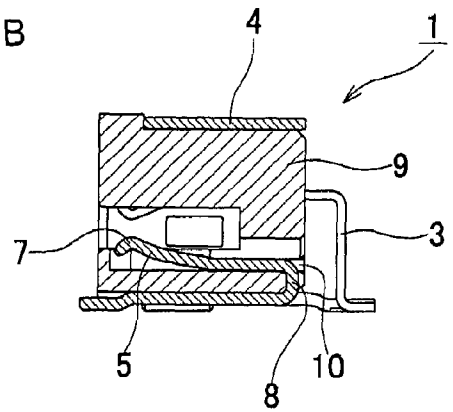
FIG. 2B is a sectional view along the IIB—IIB line of FIG. 2A.
Figure 2C:
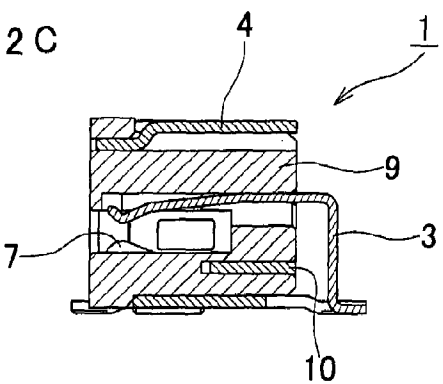
FIG. 2C is a sectional view along the IIC—IIC line of FIG. 2A.

FIG. 1 is an external perspective view of a connector and the opposing connector according to an embodiment of the invention. The arrow shown in the figure indicates the inserting direction of the opposing connector 2 to the connector 1. FIG. 2A is a front view of the connector 1 from the inserting direction of the opposing connector 2. FIG. 2B is a sectional view along the IIB—IIB line of FIG. 2A. FIG. 2C is a sectional view along the IIC—IIC line of FIG. 2A.

As shown in FIG. 1, the connector 1 is attached to a substrate 50, for which the opposing connector 2 can be inserted into and extracted from. The opposing connector 2 has a projecting part 6 projecting in the inserting direction. The projecting part 6 has a plate shape extending in one direction, and on one side surface thereof, signal electrodes 52 are disposed, and on the other side surface, a ground electrode (not shown) is disposed. In the opposing connector 2, signal electrodes 52 and cables 51 are connected to each other. By inserting the opposing connector 2 into the connector 1, the opposing connector 2 and the connector 1 fit each other and the wiring (not shown) of the substrate 50 and the cables 51 are electrically connected to each other.

The connector 1 includes, as shown in FIG. 2A, fourteen signal terminals (first terminal) 3, a shell 4, a ground terminal (second terminal) 5, and a housing 9.

As shown in FIG. 2A and FIG. 2C, the signal terminals 3 are metal-made members extending along the inserting direction of the opposing connector 2, and are aligned so as to be in parallel to each other along the direction orthogonal to the inserting direction of the opposing connector 2. The signal terminal 3 has two portions bent at a right angle in opposite directions. Thus, the signal terminal 3 is made up of three portions, i.e., a portion which is continuous to a front end and extends substantially straight along an insertion direction of a opposing connector 2, a portion which is continuous to a rear end and extends substantially straight along the insertion direction of the opposing connector 2, and a portion which connects the aforementioned two portions and extends substantially straight along a direction perpendicular to the insertion direction of the opposing connector 2. The signal terminals 3 are formed so that their extending portions on the front of the inserting direction of the opposing connector 2 are curved so as to be convex toward the ground terminal 5. When the connector 1 is fitted to the opposing connector, the front of the signal terminal 3 are electrically connected to the signal terminals 52 of the opposing connector. The signal terminal 3 are electrically connected to the signal pattern formed on the substrate 50 by solder joining.

The shell 4 is a metallic member having a roughly rectangular tubular shell shape with both ends opened, and inside the shell, the front ends of the signal terminals 3 are disposed. In other words, the shell 4 encloses the front ends of the signal terminals 3, the axis of the shell 4 being extending in a inserting direction to the opposing connector 2. The ground terminal 5 extends along the inserting direction of the opposing connector 2, and is formed integrally with the shell 4. The ground terminal 5 turns over inwardly at the rear opening edge of the shell 4 in the inserting direction and extends from the rear opening edge to a portion near the front opening edge of the shell 4. The shell 4 and the ground terminal 5 are formed by bending or the like, one molded metal plate (integral molding). The housing 9 is press-fitted to the inside of the shell 4, and encloses the front ends of the signal terminals 3.

Figure 3:
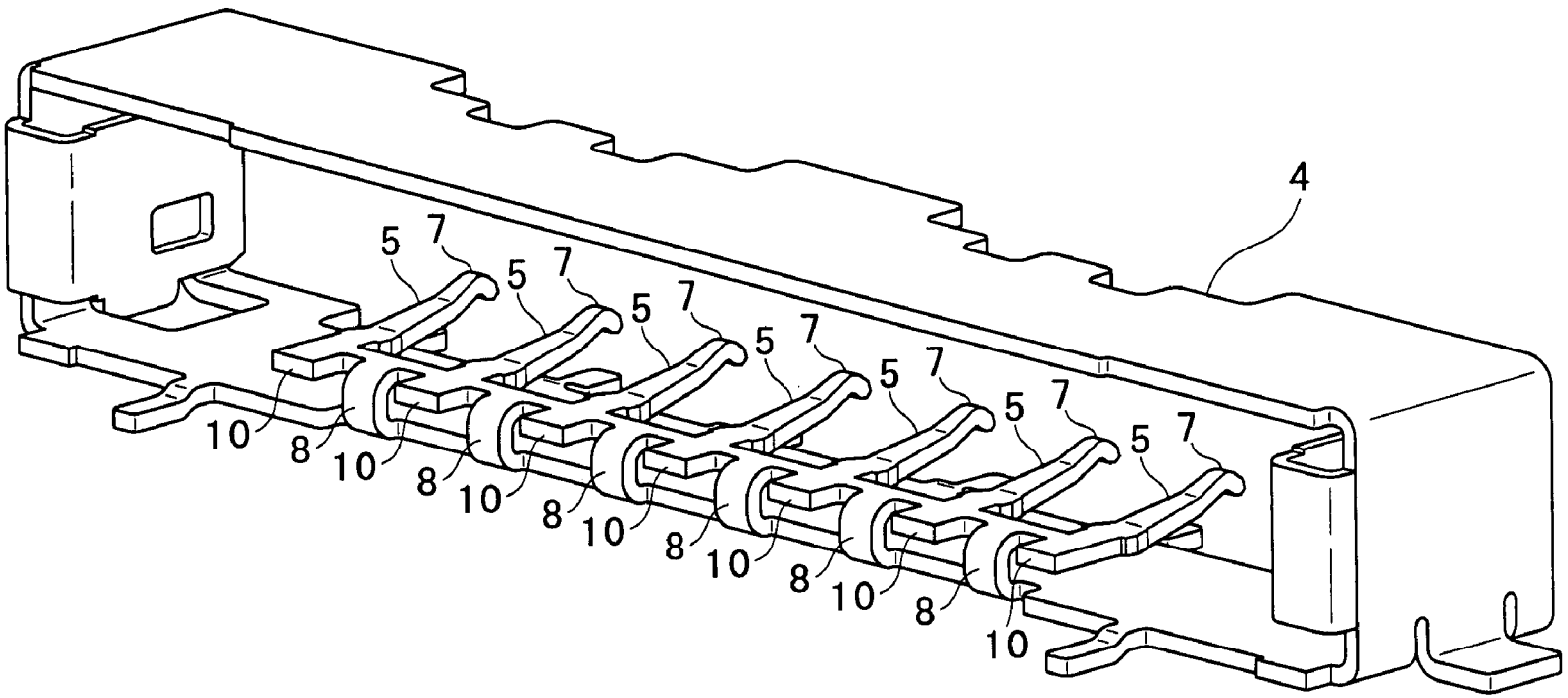
FIG. 3 is a perspective view of the shell and the ground terminal of FIG. 2.

Next, the ground terminal 5 is described in detail with reference to FIG. 3. FIG. 3 is a perspective view of the shell 5 and the ground terminal 5. As shown in FIG. 3, the ground terminal 5 has seven projecting pieces 7 and six thin plate springs 8. The projecting pieces 7 extend from the rear opening edge to the portion near the front opening edge in the shell 4, and are aligned so as to be parallel to each other along a direction orthogonal to the inserting direction of the opposing connector 2. The seven projecting pieces 7 are joined to each other near the rear end of the connector 1. The front of the projecting pieces 7 are curved so as to be convex toward the signal terminal 3 (see FIG. 2B). On the rear of the projecting pieces 7, flat surfaces 10 orthogonal to the inserting direction of the opposing connector 2 are formed.

The thin plate springs 8 turns over inwardly at the rear opening edge of the shell 4 so as to be connected to the middle points of the joining portions of the projecting pieces 7 adjacent to each other. Therefore, the projecting pieces 7 and the thin plate springs 8 are alternately disposed along the direction orthogonal to the inserting direction of the opposing connector 2.

When the connector 1 fits the opposing connector 2, due to the elastic forces of the signal terminals 3 and the ground terminal 5, the signal terminals 3 and the ground terminal 5 clip the projecting part 6 of the opposing connector 2 with a predetermined pressure. At this point, the signal terminals 51 disposed on one side surface of the projecting part 6 and the signal terminals 3 are electrically connected, and the ground terminal disposed on the other side surface of the projecting part 6 and the ground terminal 5 are electrically connected.

According to the embodiment described above, the ground terminal 5 is extended from the portion near the rear opening edge of the shell 4 to the portion near the front opening edge of the shell 4, so that the spring length of the ground terminal 5 can easily be secured. Thereby, a ground terminal 5 with a proper elastic force can easily be formed. Therefore, even when the opposing connector 2 is repeatedly inserted and extracted, the ground terminal 5 and the ground terminal of the opposing connector 2 can be electrically connected to each other without fail.

In addition, since the ground terminal 5 is formed by turns over inwardly at the rear opening edge, the ground terminal 5 can be formed without notching the side wall of the shell 4. Therefore, the strength of the shell 4 is not lowered. Furthermore, the shell and the ground terminal 5 are integrally formed, so that these can be integrally molded. Thereby, the manufacturing costs of the connector 1 can be reduced.

In addition, by adjusting the number of projecting pieces 7 and the width and pitch thereof, the elastic force of the ground terminal 5 can be adjusted.

Furthermore, by adjusting the number of thin plate springs 8 and the width and pitch thereof, the elastic force of the ground terminal 5 can be adjusted.

Furthermore, since the flat surfaces 10 are formed on the ends of the projecting pieces 7 on the rear end of the connector 1, the housing 9 can be efficiently press-fitted to the shell 4 by pressing the flat surfaces 10.

A preferred embodiment of the invention is described above, however, the invention is not limited to the above-described embodiment, and various design changes are possible within the scope of the claims for the patent. For example, in the above-described embodiment, the ground terminal 5 has the projecting pieces 7 and the thin plate springs 8, however, the invention is not limited thereto, and it is also allowed that the ground terminal is formed by integrating the projecting pieces and the thin plate springs together.

In addition, in the above-described embodiment, the ground terminal 5 has seven projecting pieces 7, however, the invention is not limited thereto, and it is allowed that the number of projecting pieces and the width and pitch of the projecting pieces are arbitrarily adjusted so that the ground terminal has a proper elastic force according to the shape, etc., of the connector.

In the above-described embodiment, the ground terminal 5 has six thin plate springs 8, however, the invention is not limited thereto, and the number of thin plate springs and the width and pitch of the thin plate springs can be adjusted so that the ground terminal has a proper elastic force according to the shape, etc., of the connector.

Furthermore, in the above-described embodiment, the ends of the thin plate springs 8 are connected between the projecting pieces 7 adjacent to each other, however, the invention is not limited thereto, and it is also possible that the ends of the thin plate springs are connected to the ends of the projecting pieces.

In addition, in the above-described embodiment, the flat surfaces 10 are formed on the ends of the projecting pieces 7 on the rear end of the connector 1, however, the flat surfaces 10 may not be formed.

Furthermore, in the above-described embodiment, the housing 9 is provided which encloses the signal terminals 3, however, the housing 9 may not be provided.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A connector comprising:

a first terminal that extends in a first direction;

a conductive tubular shell that encloses at least the ends of the first terminal, wherein the axis of the shell extends in an inserting direction toward an opposing connector; and a second terminal that is integrated with the shell, turns over inwardly at a rear opening edge of the shell in the inserting direction, and extends, while being enclosed by the shell, from the rear opening edge to a portion near a front opening edge of the shell, wherein when the opposing connector is fitted, the first and second terminals clip a projecting part of the opposing connector, whereby the first terminal is electrically connected to a signal terminal formed on the projecting part and the second terminal is electrically connected to a ground terminal formed on the projecting part.

2. The connector according to claim 1, wherein the second terminal has a plurality of projecting pieces extending from the rear opening edge to the portion near the front opening edge.

3. The connector according to claim 2, wherein the second terminal has a plurality of thin plate springs that turns over inwardly at the rear opening edge.

4. The connector according to claim 3, further comprising a housing that encloses the first terminal, wherein the shell encloses the housing, the projecting pieces and the thin plate springs are alternately disposed along a direction orthogonal to the inserting direction, and flat surfaces orthogonal to the inserting direction are formed on the rear ends of the projecting pieces.

* * * * *